United States Patent [19]

Nieman

[11] 4,055,214

[45] Oct. 25, 1977

[54] FLASH CONTROL MOLDING FOR MOLDS

[75] Inventor: John R. Nieman, Pekin, Ill.

[73] Assignee: Caterpillar Tractor Co., Peoria, Ill.

[21] Appl. No.: 683,588

[22] Filed: May 5, 1976

[51] Int. Cl.[2] ..... B22C 7/04

[52] U.S. Cl. ..... 164/241; 164/235; 164/249; 164/70; 164/262

[58] Field of Search ..... 164/69, 70, 140, 235, 164/236, 239, 241, 242, 244, 245, 248, 249, 262, 264, 412; 29/183.5, 193

[56] References Cited

U.S. PATENT DOCUMENTS

| | | | |
|---|---|---|---|
| 45,716 | 1/1865 | Howell | 164/244 |
| 128,664 | 7/1872 | Saunders | 29/193 |
| 153,863 | 8/1874 | Truesdale | 164/244 |
| 731,738 | 6/1903 | Arnold | 164/244 |
| 893,252 | 7/1908 | Kramer | 164/412 X |
| 1,365,075 | 1/1921 | Anderson et al. | 164/235 |
| 2,247,777 | 7/1941 | Hagemeyer | 164/70 |
| 2,529,647 | 11/1950 | Arnette | 164/242 |

OTHER PUBLICATIONS

"Modern Metals", Apr., 1954, p. 198.

*Primary Examiner*—Ronald J. Shore
*Attorney, Agent, or Firm*—Charles E. Lanchantin, Jr.; Oscar G. Pence

[57] ABSTRACT

A flash control molding is provided for use in association with a pattern for forming a casting cavity in a metal casting mold. The flash control molding includes an elongated strip of pliable material having a predetermined cross sectional configuration to define a thick portion for forming a flash control chamber in the mold, and a thin edge along one side of the thick portion to form a restricted opening between the flash control chamber and the casting cavity so that a casting subsequently produced in the mold is formed with controlled shaped flash which has a built-in fracture line immediately adjacent the casting proper, thereby making the flash easily and cleanly removable from the casting.

9 Claims, 9 Drawing Figures

FLASH CONTROL MOLDING FOR MOLDS

BACKGROUND OF THE INVENTION

This invention relates generally to a method and apparatus for forming molds for making metal castings and more particularly to a flash control molding for use in making controlled shaped flash about the periphery of such castings.

Obtaining a proper match between the cope and drag about the periphery of a casting cavity of a mold is sometimes quite difficult. Those skilled in the art will appreciate that if a gap occurs between the respective parting surfaces of the cope and drag when the mold is closed, flashing will occur along the parting line of the casting when it is poured. Typically, such flash must be chipped and/or ground off the casting to make the casting ready for subsequent machining or other finishing operations.

Alternately, if there is too much interference between such parting surfaces adjacent the cavity, the corners of the mold formed by the cavity and the parting line may be crushed, causing portions of the mold material to break off and fall into the cavity. This results in what is known as a crush defect in the casting.

In the past, the problem of crush defects has been somewhat alleviated by placing a relatively thin, flat strip of metal about the periphery of the pattern used to form the casting cavity in the mold. This strip produces a predetemined separation or gap between the parting surfaces of the mold about the casting cavity, thus alleviating the possibility of the corners being crushed when the mold is closed. The strips typically used are from approximately 0.03 to 0.10 inches in thickness and from approximately $\frac{1}{4}$ to $\frac{3}{4}$ inches in width, thus providing a thin flash cavity in the mold. Typically, such strips have to be hand cut and trimmed so as to be fitted about the intricate shapes of typical patterns. As will be appreciated, this operation is extremely time-consuming and consequenty quite costly.

It will also be appreciated that the use of such strip will result in the production of flash about the casting which must subsequently be removed. The normal flash produced by such prior art strips is quite difficult to remove because they produce a flash fin which is strongest at its connection with the casting. This is due to the slight rounding of the corners between the casting and flash cavities together with the progressively decreasing filling of the thin flash cavity by the molten metal which gives the fins a somewhat tapered or wedge shaped configuration. Thus, the flash fins, when struck with a hammer or other tool, will tend to break off in little chunks at a point away from the casting itself. This leaves a ridge about the casting which typically has to be ground away with a grinding wheel. Such grinding and chipping is normally quite time consuming and tedious and significantly contributes to the overall cost of the casting.

SUMMARY AND OBJECTS OF THE INVENTION

Accordingly, it is an object of this invention to provide a method and apparatus of making a casting free from crush defects more economically than castings made by prior foundry practices.

Another object of this invention is to provide a flash control molding for making a flash chamber in the parting line of a mold about the casting cavity of such mold so as to produce controlled shape flash which has a built-in fracture line contiguous to the casting so that the flash is cleanly and easily removed from the casting.

Other objects and advantages of the present invention will become more readily apparent upon reference to the accompanying drawings and following description.

DESCRIPTION OF THE PREFERRED EMBODIMENTS

Figure 1:
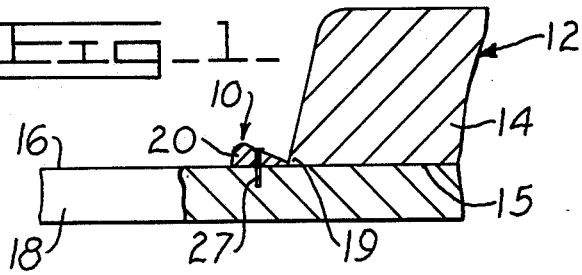
FIG. 1 is a fragmentary cross sectional view of a pattern assembly for forming one-half of a mold and includes a flash control molding embodying the principles of the present invention which is attached thereto.

Referring more particularly to the drawings, a flash control molding embodying the principles of the present invention is generally indicated at 10 in FIG. 1 in association with a pattern assembly 12. The pattern assembly 12 is of a conventional construction and includes a split-type pattern 14 which may be made in any well known manner.

The pattern 14 is provided with a flat side 15 for mounting against a true surface 16 of a match or pattern plate 18. The flat side of the pattern and its adjacent sidewall define a peripheral edge 19 disposed along the true surface 16 of the pattern plate.

In general, the flash control molding 10 includes an elongated strip 20 of pliable material to allow the strip to be bent and shaped to conform to whatever peripheral shape the pattern 14 may have. While many suitable pliable materials may be used, a soft metal, such as aluminum, is preferred because of its inherent resistance to abrasion. This, as will be more fully understood, is important for molding purposes, hereinafter more fully described, because of the longer useful life it provides. the strip also preferably has a fixed cross sectional configuration to permit the economical forming of the strip by extrusion.

Figure 7:
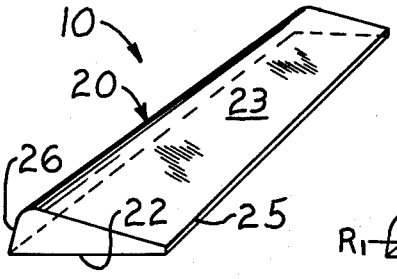
FIG. 7 is a greatly enlarged isometric view of a length of the molding of FIGS. 1 and 2.

As best shown in FIG., 7, the strip has a predetermined cross sectional configuration which includes a thick portion having a substantially flat face 22, and an opposite contoured face 23. The flat face 22, it will be appreciated, is provided for mating engagement against the true surface 16 of the pattern plate 18. The contoured face 23 is provided for varying the lateral thickness of the strip so as to provide a thin edge 25 along the one side of the thick portion in adjoining relationship with the faces 22 and 23. Such thin edge should be substantially less than the thick portion of the strip and preferably less than $\frac{1}{2}$ the maximum thickness thereof. Also, the point of maximum thickness of the strip is preferably as far as possible from the thin edge, such as along the opposite side 26 thereof. In the embodiment shown in FIG. 7, the contoured face 23 is simply provided by a generally flat surface which is angled relative to the flat face 22, thus giving the strip a generally wedge shaped cross sectional configuration.

the thin edge 25, as shown in FIG. 1, is disposed in abutting engagement against the periphery of the pattern. The strip is secured in such position by any suitable means, such as by a plurality of pins, one of which is shown at 27, which are driven into suitable holes drilled through the strip and into the pattern plate 18.

Figure 3:
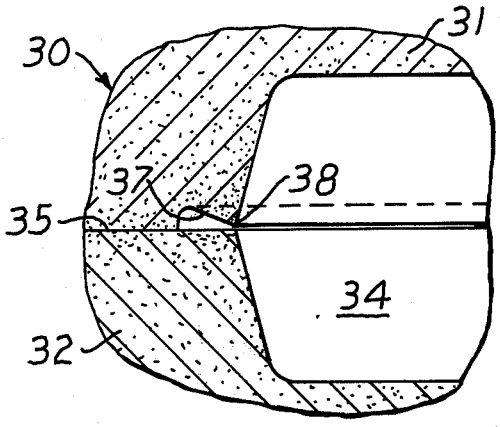
FIG. 3 is a fragmentary cross sectional view of a mold constructed from the pattern assembly of FIG. 1.

The above described pattern is then used to form a mold 30, such as depicted in FIG. 3. The mold 30 illustrated is of the commonly used book-type having opposite cope and drag portions 31 and 32, respectively, which form opposite mating halves of a mold or casting cavity 34. In this regard, it will be understood that the pattern assembly 12 is used to form the cope portion of the mold and another suitable pattern, not shown, of a conventional design is used to form the drag portion of the mold or vice versa. The cope and drag portions are joined together in a conventional manner along a parting line 35 formed by the true surfaces of their respective pattern plates, as will be understood by those skilled in the art. Both the cope and drag portions are made from any suitable mold material commonly employed in the metal founding industry, such as sand or the like.

It will be appreciated that with the flash control molding 10 being mounted about the peripheral edge 19 of the pattern 14 when the mold 30 is made, the mold will have formed therein a flash control chamber 37 which has a shape conforming to that of the strip 20. Thus, the chamber will lie along the parting line 35 and communicate with the casting cavity, through a restricted opening 38 formed by the thin edge 25.

Figure 5:
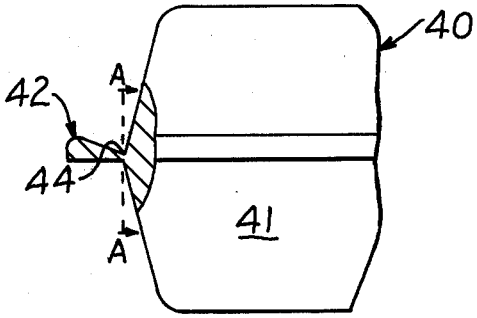
FIGS. 5 and 6 are fragmentary elevational views with portions broken away of metal castings made in the molds of FIGS. 3 and 4, respectively.

The pouring of molten metal, such as iron or steel, into the mold 30 in a conventional casting operation will produce a casting, such as shown at 40 in FIG. 5. The casting 40 will have a body portion 41 conforming to the shape of the casting cavity 34 of the mold and controlled shaped flash 42 formed about the periphery of the body portion conforming to the shape of the flash chamber 37.

The controlled shape flash 42 is connected to the body portion of the casting by a relatively thin neck 44 provided by the restricted opening 38 of the flash chamber 37. The flash also has a substantially thicker mass spaced outwardly from such neck conforming to the thick portion of the strip. As a result, the flash is provided with a built-in fracture line, such as indicated along line A—A, immediately adjacent the casting body so that by striking the flash with a tool, such as a hammer or chisel, the flash will break off cleanly from the body along such fracture line without leaving a sizeable ridge or other protruberance which must subsequently be removed by a grinding wheel or the like.

Figure 2:
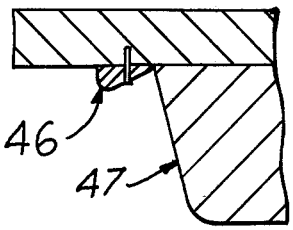
FIG. 2 is a view similar to FIG. 1, but of a pattern assembly for making the opposite half of a mold.

The present invention also contemplates the use of a similar flash control molding, as shown at 46 in FIG. 2 on a similar pattern assembly 47 for use in combination with the pattern assembly 12 of FIG. 1.

Figure 4:
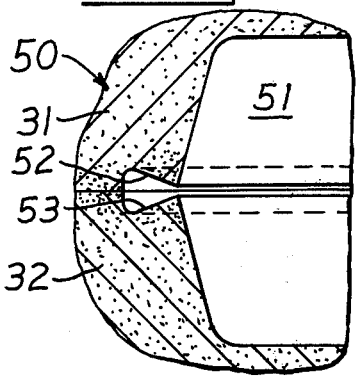
FIG. 4 is a view similar to FIG. 3, but illustrating a mold constructed from the pattern assemblies of both FIGS. 1 and 2.
Figure 6:
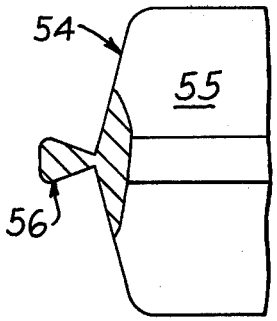

When the two pattern assemblies 12 and 47 are used together to form a mold 50, as shown in FIG. 4, a casting cavity 51 is formed having two mating flash chambers 52 and 53, each formed in respective ones of the cope and drag portions 31, 32 of the mold about the periphery of such casting cavity. This ultimately forms a casting 54, as shown in FIG. 6, which has a body portion 55 with controlled shaped flash 56 about its periphery which is double the size of the flash of FIG. 5. The above described use of two molding strips is one way of varying the size of flash. The particular flash size desired depends upon many factors, as those skilled in the art will appreciate, such as the type of metal being used, its pouring temperature, the size of casting being poured, and the desired characteristics of the casting to be formed. Other ways of varying the flash are by merely changing the size of the strip used or by changing the shape of such strip. In general, however, the width of the strip is preferably within a range of from $\frac{1}{4}$ to 2 inches, with the maximum thickness varying from $\frac{1}{8}$ to $\frac{1}{4}$ inches.

Figure 8:
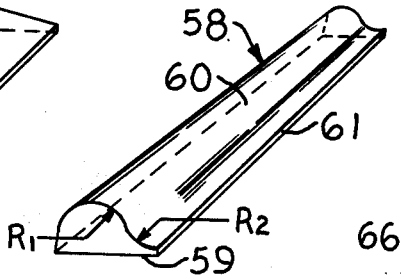
FIGS. 8 and 9 are views similar to FIG. 7, but showing alternate shapes of the molding.
Figure 9:
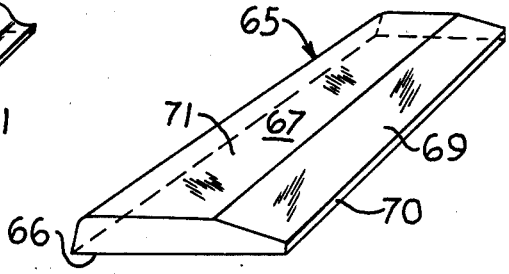

Two alternate strip shapes are shown in FIGS. 8 and 9, respectively. In the embodiment of FIG. 8, a strip 58 is shown which has a flat face 59 similar to face 22 of the strip 20, and an opposite contoured face 60, which is described by a pair of tangentially disposed radii $R_1$ and $R_2$, respectively, to provide a concave configuration adjacent one side thereof and a semicircular configuration adjacent the opposite side thereof, with the concave configuration defining a thin edge 61.

The embodiment of FIG. 9, in turn, shows a strip 65 having a similar flat face 66 and an opposite contoured face 67. The contoured face of this embodiment has an angled portion 69 to reduce the thickness along one side thereof to provide a thin edge 70 and a straight portion 71 parallel to the flat face 66. This configuration allows the width of the strip to be varied without its thickness becoming unduly great, thus minimizing the mass of the flash produced thereby.

Thus, as is readily apparent from the foregoing, the particular construction of the flash control molding of the present invention is capable of forming controlled shaped flash about a casting, which flash has a built-in fracture line immediately adjacent the body of the casting so as to enable such flash to be cleanly knocked off the body without leaving any undesirable ridge or the like which must be subsequently removed by grinding or other operation.

While the present invention has been described and shown with particular reference to the preferred embodiments thereof, it will be apparent the variations might be possible that would fall within the scope of the present invention which is not intended to be limited except as defined in the following claims.

What is claimed is:

1. A flash control molding in combination with a pattern having a nonlinear peripheral edge for forming a casting cavity in a mold, comprising:

an elongated strip of material having a preselected and substantially uniform cross sectional configuration throughout its length and defining a relatively thick edge portion and a juxtaposed relatively thin edge portion, said thin edge portion being disposed in abutting relation against said peripheral edge of the pattern with said thick edge portion spaced from the pattern, said elongated strip being separable from the pattern and of a pliable material having physical properties sufficient for shaping thereof conformingly to the nonlinear contour of said peripheral edge of the pattern.

2. The flash control molding of claim 1 wherein said elongated strip has a substantially flat face along one side thereof and a contoured face along the other side thereof and controllably increasing in thickness in a direction away from said thin edge portion.

3. The flash control molding of claim 2 wherein said substantially flat face is arranged in a plane substantially normal to said peripheral edge of the pattern.

4. The flash control molding of claim 2 wherein said contoured face is angled relative to said substantially flat face to provide a generally wedge shaped cross section.

5. The flash control molding of claim 2 wherein said contoured face has a generally concave configuration adjacent said relatively thin edge portion and a generally semicircular configuration adjacent said relatively thick edge portion.

6. The flash control molding of claim 2 wherein said contoured face has a convergingly angled portion adjacent and extending toward said relatively thin ege portion and a generally straight portion parallel to said relatively flat face adjacent said relatively thick edge portion.

7. The flash control molding of claim 1 wherein said pliable material is soft aluminum.

8. The flash control molding of claim 1 wherein said elongated strip has a plurality of spaced attachment holes along its length.

9. The flash control molding of claim 8 wherein both said pattern and said elongated strip are mountable conformingly against a planar surface of a pattern plate, with said elongated strip being connected to said pattern plate by a plurality of pins extending through said attachment holes and into said pattern plate.

* * * * *